United States Patent [19]

Sakamoto

[11] 4,111,152

[45] Sep. 5, 1978

[54] ELECTROSTATOGRAPHIC APPARATUS COMPRISING IMPROVED DEVELOPMENT BIAS MEANS

[75] Inventor: Koji Sakamoto, Tokyo, Japan

[73] Assignee: Ricoh Co., Ltd., Tokyo, Japan

[21] Appl. No.: 796,108

[22] Filed: May 12, 1977

[30] Foreign Application Priority Data

May 17, 1976 [JP] Japan ..... 51-56386

[51] Int. Cl.[2] ..... G03G 15/044; G03G 15/14; B05C 11/00

[52] U.S. Cl. ..... 118/7; 118/647; 118/658

[58] Field of Search ..... 118/7, 646, 657, 658, 118/647

[56] References Cited

U.S. PATENT DOCUMENTS

| | | | |
|---|---|---|---|
| 3,438,705 | 4/1969 | King | 118/7 |
| 3,527,651 | 9/1970 | Shelffo | 118/7 X |
| 3,599,605 | 8/1971 | Ralston | 118/647 |
| 3,654,893 | 4/1972 | Piper et al. | 118/657 X |
| 3,674,532 | 7/1972 | Morse | 118/657 X |
| 3,779,204 | 12/1973 | Altmann | 118/647 X |
| 3,877,413 | 4/1975 | Rowell et al. | 118/647 X |
| 3,892,481 | 7/1975 | Schaefer et al. | 118/7 X |
| 3,918,395 | 11/1975 | Fearnside | 118/657 X |
| 3,922,380 | 11/1975 | Rowell et al. | 118/647 X |
| 3,941,084 | 3/1976 | Kurzita | 118/646 |
| 3,981,267 | 9/1976 | Gardiner et al. | 118/7 |
| 3,981,268 | 9/1976 | Tsukamoto | 118/657 |
| 3,990,394 | 11/1976 | Katakura | 118/658 |
| 4,003,650 | 1/1977 | Courtney et al. | 118/647 X |

*Primary Examiner*—Mervin Stein
*Assistant Examiner*—Andrew M. Falik
*Attorney, Agent, or Firm*—Frank J. Jordan

[57] ABSTRACT

A magnetic brush applies a toner substance to a photoconductive drum for development. A bias voltage source applies a bias voltage across the series arrangement of a variable resistance means, the magnetic brush, the toner substance between the magnetic brush and the drum and a non-image portion of the drum. The variable resistance means is adjusted until the current therethrough is a predetermined optimum value, and thereafter maintained constant for development, thereby compensating the bias voltage for fatigue of the toner substance.

6 Claims, 5 Drawing Figures

ELECTROSTATOGRAPHIC APPARATUS COMPRISING IMPROVED DEVELOPMENT BIAS MEANS

BACKGROUND OF THE INVENTION

The present invention relates to an electrostatographic apparatus such as a copying machine comprising an improved development bias means.

In a typical electrostatic copying machine, a photoconductive drum is charged and radiated with a light image of an original document to form an electrostatic image through localized photoconduction. A developing means such as a magnetic brush applies a toner substance to the drum which develops the electrostatic image to produce a toner image. The toner image is transferred and fixed to a copy sheet to provide a permanent reproduction of the original document.

In order to prevent the white areas of the image from printing gray on the copy sheet, a bias voltage having the same polarity as the electrostatic image on the drum is applied to the magnetic brush. The magnitude of the bias voltage is on the order of the magnitude of the electrostatic image in the white image areas. By this means, toner particles are prevented from being attracted to the white image areas.

Due to current flow from the bias voltage source through the magnetic brush and toner substance to the drum, the bias voltage is not the controlling factor in the bias effect. The controlling factor is the bias current, which is dependent on the electrical resistance of the toner substance. Therefore, applying a predetermined bias voltage under all conditions will not produce correct development bias.

Where the toner substance comprises a magnetic carrier and toner particles made of a powdered resin, fatigue of the toner substance is produced by friction between the particles. A charge of a polarity opposite to that of the toner particles develops between the carrier particles after prolonged use. This charge reaches a saturation value and limits the amount of charge which can be produced on the toner particles. In addition, "spent toner particles" are produced in the toner substance which decrease the effective contact area between fresh toner particles and carrier particles and promote the formation of an opposite charge on the toner particles. A substantial proportion of spent toner particles in the toner substance increases the electrical resistance thereof since the effective contact area between the carrier particles is decreased. The increased toner resistance decreases the bias current at a specific value of applied bias voltage.

For this reason the bias effect cannot be properly produced by simply applying a predetermined bias voltage between the magnetic brush and the drum. It is furthermore not effective to provide a constant bias current by means of a constant current source, since this produces uneven copy density with certain image patterns.

SUMMARY OF THE INVENTION

In accordance with the present invention a magnetic brush applies a toner substance to a photoconductive drum for development. A bias voltage source applies a bias voltage across the series arrangement of a variable resistance means, the magnetic brush, the toner substance between the magnetic brush and the drum and a non-image portion of the drum. The variable resistance means is adjusted until the current therethrough is a predetermined optimum value, and thereafter maintained constant for developing, thereby compensating the bias voltage for fatigue of the toner substance. In one form of the invention the variable resistance means comprises a variable resistor. In another form of the invention the variable resistance means comprises an electrode connected to the bias voltage source. The electrode contacts the toner substance on the magnetic brush. The resistance is varied by moving the electrode toward and away from the area of mutual contact of the magnetic brush, toner substance and drum.

It is an object of the present invention to provide an improved means for applying a bias voltage in an electrostatographic apparatus such as an electrostatic copying machine which effectively applies the correct bias voltage in accordance with the electrical resistance of the toner substance which varies with fatigue, the presence of spent toner particles and the like.

It is another object of the present invention to provide an improved electrostatographic apparatus in which a cause of white image areas printing gray is eliminated regardless of the condition of a toner substance.

It is another object of the present invention to provide an electrostatic copying machine comprising an improved development bias means which eliminates a cause of uneven printing of image areas in copies.

It is another object of the present invention to provide a generally improved electrostatic copying machine.

Other objects, together with the foregoing, are attained in the embodiments described in the following description and illustrated in the accompanying drawing.

DESCRIPTION OF THE PREFERRED EMBODIMENTS

While the electrostatographic apparatus of the invention is susceptible of numerous physical embodiments, depending upon the environment and requirements of use, substantial numbers of the herein shown and described embodiments have been made, tested and used, and all have performed in an eminently satisfactory manner.

Figure 1:
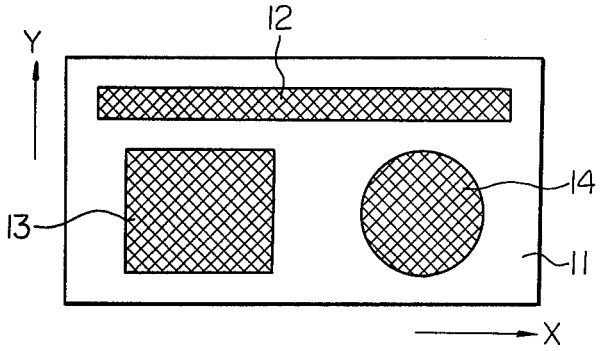
FIG. 1 is a diagram illustrating an electrostatic image on a photoconductive drum having a particular image pattern.
Figure 2:
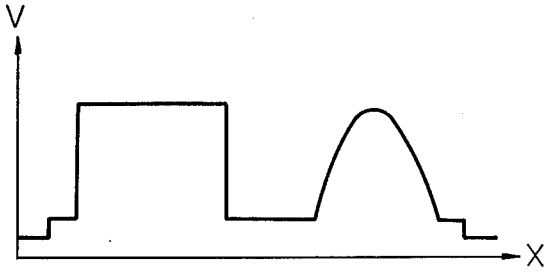
FIG. 2 is a graph of the average electrostatic potential across the image.

Referring now to FIG. 1 of the drawing, an electrostatic image on a photoconductive drum 11 of an electrostatic copying machine (not shown) is graphically illustrated as comprising a dark elongated rectangle 12, a square 13 and a circle 14. The drum 11 is moved upwardly, or in a X-direction for development. FIG. 2 shows the average electrostatic potential V of the electrostatic image on the drum 11 taken in an X-direction which is perpendicular to the Y-direction.

Figure 3:
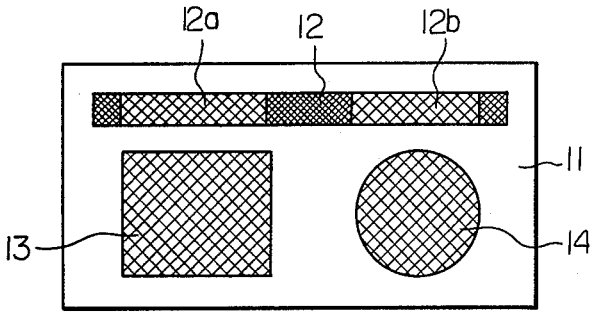
FIG. 3 is a diagram of a copy produced from the electrostatic image of FIG. 1 showing unevenness of copy density.

FIG. 3 shows how portions 12*a* and 12*b* of the rectangle 12 will print lighter than the remainder of the rectangle 12 if a constant bias current is applied for development. If a constant bias voltage of the wrong magnitude were applied, the white or background areas of the copy would be too light or too dark where the bias voltage is too high and too low respectively.

Figure 4:
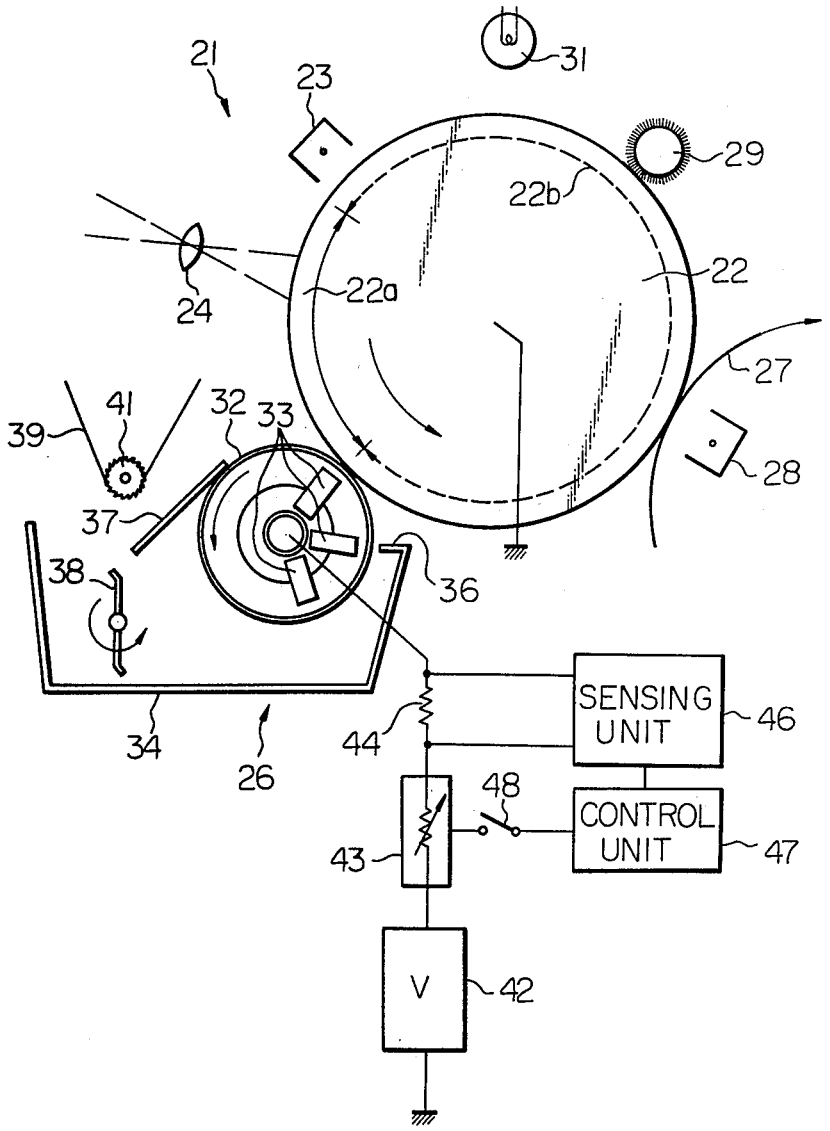
FIG. 4 is a schematic view of a first embodiment of an electrostatographic apparatus according to the present invention.

FIG. 4 shows a first embodiment of an electrostatic copying machine of the present invention which is generally designated by the reference numeral 21. The copying machine 21 comprises a photoconductive drum 22 which is rotated counterclockwise at constant speed. Although not shown in detail, the drum 22 comprises an electrically conductive, grounded cyclindrical core on the periphery of which is formed a photoconductive coating.

A corona charging unit 23 applies a uniform electrostatic charge to the drum 22 and an exposure unit which is symbolically illustrated as a lens 24 focusses a light image of an original document (not shown) onto the drum 22 which causes the formation of an electrostatic image through localized photoconduction. A developing unit 26 applies a toner substance which typically comprises ferromagnetic carrier particles and toner particles onto the drum 22. The toner particles adhere to the areas of high electrostatic potential on the drum 22 to form a toner image thereon.

A copy sheet 27 is fed in contact with the drum 22 by a transfer feed means which is not shown and a transfer charger 28 applies an electrostatic charge to the copy sheet 27 through the back thereof which attracts the toner image from the drum 22 onto the copy sheet 27. Thereafter, a fixing unit which is similarly not shown fixes the toner image to the copy sheet 27 through heat, pressure or a combination thereof. A cleaning brush 29 removes any residual toner substance from the drum 22 and a lamp 31 discharges the drum 22 through photoconduction.

The developing unit 26 is of the magnetic brush type and comprises a rotary cylinder 32 which is rotated at constant speed in the counterclockwise direction in close proximity to the drum 22. The cylinder 32 in formed of an electrically conductive material. A plurality of magnets 33 are fixedly mounted inside the cylinder 32. The lower portion of the cylinder 32 is immersed in the toner substance which is contained in a developing tank 34. Due to the force of the magnets 33, the toner substance adheres to the cylinder 32 to form a rotating magnetic brush (not designated) which brushingly contacts the drum 22 to effect development. A doctor blade 36 maintains the thickness of the magnetic brush at a predetermined value. A scraper blade 37 removes the toner substance remaining on the cylinder 32 after development and returns the same to the tank 34. A rotary agitator 38 homogenizes the toner substance in the tank 34. Fresh toner particles are supplied into the tank 34 to replenish those consumed in the copying operation from a hopper 39 by means of a serrated cylinder 41 which is rotated in an intermittent manner.

In accordance with the present invention a bias voltage is applied to the cylinder 32 of the magnetic brush from a fixed voltage source 42. More specifically, one end of the voltage source 42 is grounded and the other end is connected to the cylinder 32 through a variable resistor 43 and a fixed resistor 44. The cylinder 32 is electrically connected to the drum 22 through the toner substance of the magnetic brush. Since the core of the drum 22 is grounded, a closed series bias circuit arrangement is provided.

A sensing unit 46 is connected across the resistor 44 to sense or measure the current flow through the bias circuit. Since the resistor 44 is fixed, the voltage thereacross is proportional to the current therethrough multiplied by the value of the resistor 44. The sensing unit 46 is connected to a control unit 47 which is connected to control the variable resistor 43 through a switch 48.

In accordance with the present invention an image area 22*b* of the drum 22 is used for electrostatic copying and a non-image area 22*a* is not used for copying. The non-image area 22*a* is discharged by the lamp 31 and is not exposed by the exposure unit 24. However, the non-image area 22*a* is developed.

The switch 48 is closed when the leading edge of the non-image area 22*a* reaches the developing unit 26 and the control unit 47 is triggered for a sweep. More specifically, the control unit 47 is connected to move the slider (not designated) of the variable resistor 43 to vary the resistance thereof from high to low or vice-versa when the switch 48 is closed. The sensing unit 46 is adapted to produce a signal when the sensed current reaches a predetermined value. This causes the control unit 47 to stop the sweep and maintain the resistance of the resistor 43 at the instantaneous resistance value present when the sensing unit 46 senses the predetermined current. In other words, the resistance of the resistor 43 is adjusted until the current through the bias circuit reaches a predetermined value. The switch 48 is opened when the leading edge of the image area 22*b* reaches the developing unit 26. The image area 22*b* is then developed without further change in the resistance of the resistor 43.

The predetermined bias current is determined in the following manner. Using fresh toner substance, the resistor 43 is manually adjusted until perfect copies are produced. The current flow through the bias circuit when the non-image area 22*a* is being developed is then measured. This is set into the sensing unit 46 as the predetermined value of current.

Since the current flow through the bias circuit obeys Ohm's law, the bias current during development of the image area 22*b* is proportional to the bias current during development of the non-image area 22*a*. The present apparatus effectively functions to measure the resistance of the toner substance and adjust the bias voltage in accordance therewith. Making the measurement using the non-image area 22*a* as a reference surface eliminates the effect of the electrostatic image pattern from the measurement. In other words, the present apparatus adjusts the bias current to an optimum value, compensating for the resistance of the toner substance, and thereafter maintains the bias voltage constant to preclude the effect illustrated in FIG. 3.

Figure 5:
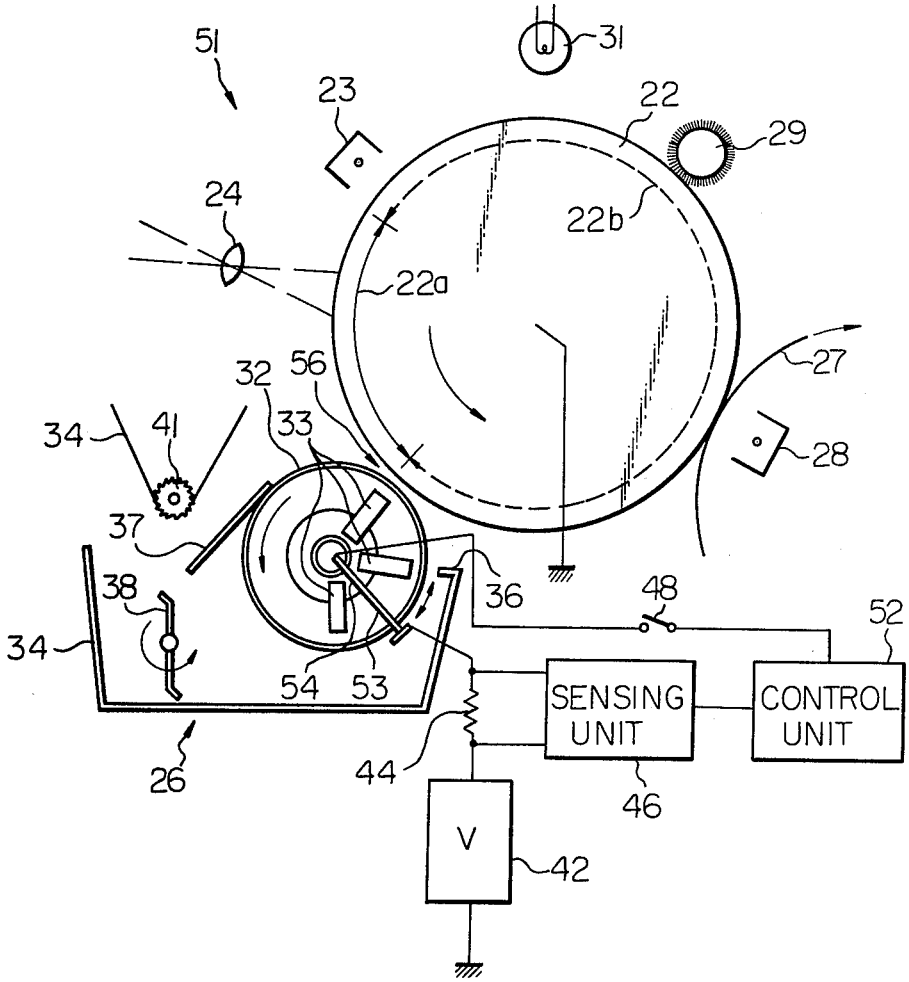
FIG. 5 is similar to FIG. 4 but shows a second embodiment of the present invention.

FIG. 5 illustrates another embodiment of the present copying machine in which like elements are designated by the same reference numerals, the copying machine of FIG. 5 being generally designated as 51. The difference between the embodiments of FIGS. 4 and 5 is that in FIG. 5 the variable resistor 43 is replaced by an electrode 53 which is mounted at the end of an insulative arm 54 pivotal about the axis of the cylinder 32. The electrode 53 is spaced from the periphery of the cylinder 32 by an amount small enough that the electrode 53 contacts the toner substance of the magnetic brush on the cylinder 32.

In addition, the control unit 47 is replaced by a control unit 52 which moves the electrode 53 toward and away from an area of mutual contact of the cylinder 32, toner substance and drum 22 which is designated at 56. The electrode 53 provides the same function as the resistor 43 since it varies the resistance of the bias circuit and thereby the bias current. More specifically, the resistance between the electrode 53 and the drum 22 corresponds to the distance between the electrode 53 and the area 56 since the toner substance of the magnetic brush ohmically connects the electrode 53 to the drum 22. The further the electrode 53 from the area 56, the greater the resistance in the bias circuit. Even greater precision may be introduced by forming an electrically insulative layer on the cylinder 32 so that all bias current must pass through the toner substance of the magnetic brush, although not illustrated.

In summary, it will be seen that the present invention provides an electrostatographic apparatus such as the illustrated electrostatic copying machine or an electrostatic recording machine (not illustrated) in which a bias voltage applied to a magnetic brush or similar developing unit is varied in accordance with the resistance of the toner substance to produce an optimum bias effect. Various modifications will become possible for those skilled in the art after receiving the teachings of the present disclosure without departing from the scope thereof. As a typical example, although the variable resistance in the bias circuit is shown and described as being mechanically manipulated to change the resistance thereof, a solid state circuit in which the resistance is varied electronically may be provided which lies within the scope of the present invention. As another typical modification, a separate element may be provided as the reference surface rather than the non-image portion 22*a* of the drum 22. Of course, the drum 22 may be replaced by a photoconductive endless belt or a photoconductive sheet.

What is claimed is:

1. In an electrostatographic apparatus having a photoconductive member and a developing means for applying a toner substance to the photoconductive member for development, the combination comprising:

a variable bias voltage means for applying a bias voltage across the developing means and the photoconductive member, the bias voltage means comprising a fixed voltage source and a variable resistance means connected between the voltage source and the developing means;

sensing means for measuring the electrical resistance of the toner substance, the bias voltage means being responsive to the sensing means in such a manner that the bias voltage is set for development in accordance with said resistance of the toner substance; and a reference surface means provided on the photoconductive member, the sensing means being responsive to the electrical current through the voltage source, variable resistance means, toner substance and reference surface means, the bias voltage means being constructed to automatically adjust the electrical resistance of the variable resistance means to a value such that the sensing means senses a predetermined electrical current and maintains said resistance of the variable resistance means constant at said value for development.

2. An apparatus as in claim 1, in which the variable resistance means comprises a variable resistor.

3. An apparatus as in claim 1, in which the variable resistance means comprises an electrode connected to the voltage source and contacting the toner substance on the developing means, the bias voltage means moving the electrode toward and away from an area of mutual contact of the developing means, toner substance and photoconductive member to decrease and increase said resistance of the variable resistance means respectively.

4. An apparatus as in claim 1, in which the reference surface means comprises a non-image area of the photoconductive member.

5. An apparatus as in claim 3, in which the developing means comprises a magnetic brush, said area of mutual contact being between the magnetic brush, toner substance and photoconductive member.

6. An apparatus as in claim 5, in which the photoconductive member comprises a rotary photoconductive drum.

* * * * *